United States Patent [19]

Voegeli

[11] Patent Number: 4,707,038

[45] Date of Patent: Nov. 17, 1987

[54] DISPLAY RACK

[76] Inventor: Ronald C. Voegeli, 918 Gibbs Rd., Venice, Fla. 33595

[21] Appl. No.: 817,087

[22] Filed: Jan. 8, 1986

[51] Int. Cl.[4] ..... B65H 1/04

[52] U.S. Cl. ..... 312/257 SM; 221/226; 248/188.8; 312/61; 312/71; 312/256; 312/257 R

[58] Field of Search ..... 248/188.9, 188.8; 221/226, 227, 232; 312/263, 160, 50, 257 R, 257 SM, 257 A, 257.5 K, 255, 256, 71, 61

[56] References Cited

U.S. PATENT DOCUMENTS

| | | | |
|---|---|---|---|
| 3,856,374 | 12/1974 | Christen | 312/263 |
| 4,201,428 | 5/1980 | Johnson | 312/263 X |
| 4,277,121 | 7/1981 | Possati et al. | 312/257 A X |
| 4,289,363 | 9/1981 | Andersson et al. | 312/263 X |
| 4,296,982 | 10/1981 | Kullander | 312/263 X |
| 4,307,588 | 12/1981 | Smith et al. | 312/257.5 M X |
| 4,428,631 | 1/1984 | Cope et al. | 312/255 X |
| 4,449,643 | 5/1984 | Voegeli | 312/257.5 K |
| 4,462,647 | 7/1984 | Key | 312/263 X |

*Primary Examiner*—Kenneth J. Dorner

*Assistant Examiner*—Thomas A. Rendos

*Attorney, Agent, or Firm*—Burns, Doane, Swecker & Mathis

[57] ABSTRACT

A knock-down newspaper rack includes side and rear walls defined by a sheet of metal which is bent along two vertical corners. The side and rear walls include horizontal flanges along their lower ends, the flanges extending inwardly and resting upon ground support legs. A front unit includes a frame and a door swingably mounted on the frame. The frame includes a pair of vertical rearwardly open channels which receive front vertical edges of the side walls. Those front edges are bent to create a firm frictional lock within the channels. A cover is positioned atop the housing and front unit. The cover includes a front edge formed as a rearwardly open channel to receive a forwardly extending horizontal upper edge of the frame to lock the cover to the front unit. Upper edges of the side and rear walls are bent inwardly, and the cover includes downwardly depending flanges which fit over, the outside faces of those upper edges to lie in frictional engagement with the side and rear walls.

1 Claim, 8 Drawing Figures

10
12
14
16
18
20
22
24
28
30
31
32
34
36
40
42
44
46
48
50
51
52
53
54
56
58
59
60
66
68
70
80
84
90
94
96
98
100
102
104
106
108
110
120
122
124
126
130
132
134

53
60
36
51
20

92
90
70
104
18
106
100
98
126
128
78
50
124
76
10
80
120
122
84
5
5
86
16
68
134
66
22
36
86
72
60
56
55
61
54
132
30
34
32
28
22
12
20

Fig. 5
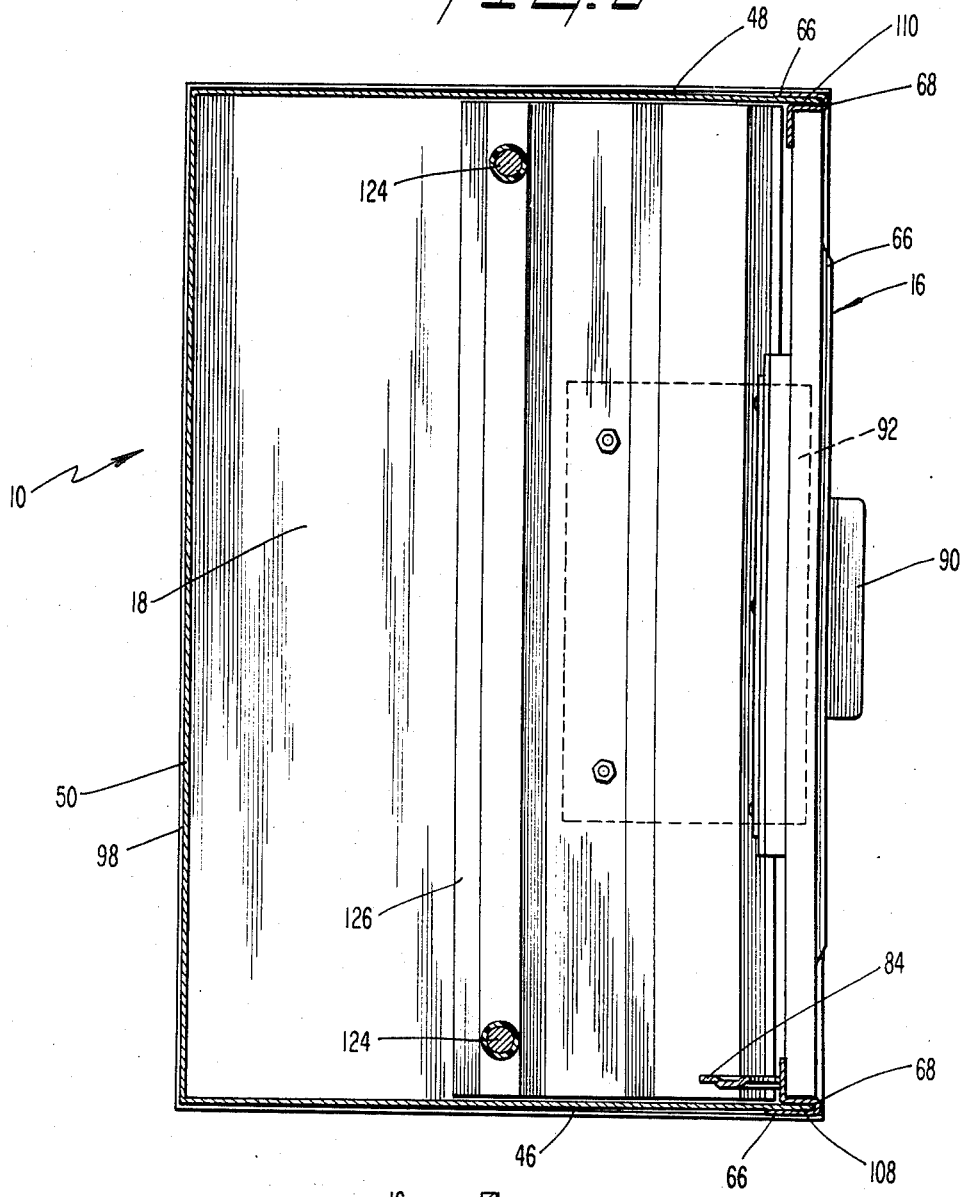
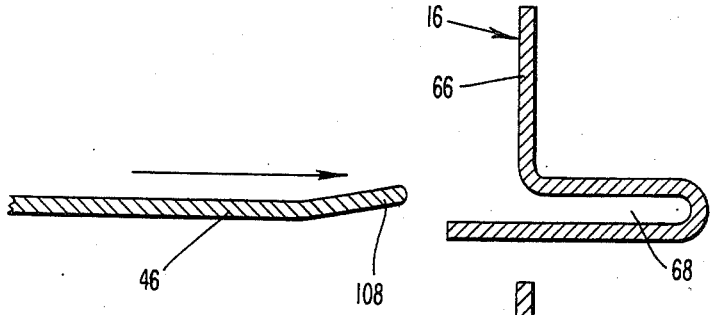
Fig. 6
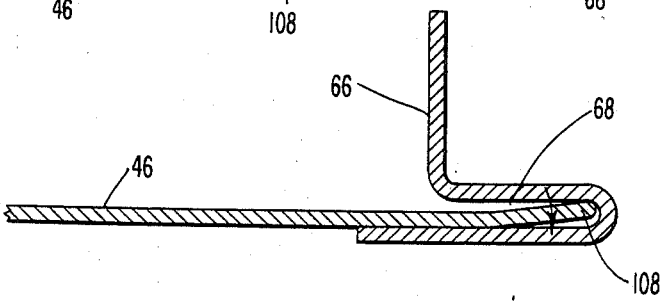
Fig. 7

DISPLAY RACK

BACKGROUND AND OBJECTS OF THE INVENTION

The present invention relates to display racks for publications such as newspapers and, in particular, to such display racks which can be shipped in a disassembled condition and easily assembled without the need for welding.

A display rack of that type is disclosed for example in U.S. Pat. No. 4,449,643, wherein the sides, back, and front walls of a rack are effectively held between a ground support and a top cover. The ground support and cover are drawn together by means of vertical rods which also serve as guides for an elevator shelf. No welding is involved in the assembly of such a rack which is advantageous, since it is difficult to paint over welds. Notwithstanding the merits of that design, room for improvement remains. For example, that design involves the provision of upwardly open channels on the ground support to receive lower edges of the side and rear walls. Such channels may tend to collect water which promotes rusting.

It is, therefore, an object of the present invention to provide a novel display rack which avoids such shortcomings.

Another object is to provide a display rack which avoids the presence of upwardly open channels.

A further object is to provide a display rack which can be shipped in a disassembled state and be easily erected without the need for welds.

A further object is to provide a display rack which is highly sturdy when assembled.

An additional object is to provide a display rack which can be assembled without the use of welds to form a rattle-resistant structure.

SUMMARY OF THE INVENTION

These and other objects are achieved by the present invention which relates to a display rack for publications such as newspapers. In one aspect of the invention, the rack comprises a pair of base legs supported on the ground. Each base leg includes a horizontal ledge spaced above the ground at a front end of the base leg, and an upstanding flange at a rear end of the base leg. The upstanding flange defines an upwardly projecting tongue. A housing is provided which comprises upstanding side walls and an upstanding rear wall. The walls form horizontal flanges along lower edges thereof. Front portions of the flanges are seated on the ledge. Rear portions of the flanges include horizontal slots through which the tongue project. Fasteners are provided for fastening the front portions of the flanges to the bases and for fastening the tongues to the rear walls.

In another aspect of the invention, the side and rear walls are formed by a sheet of material bent along two vertical corners. The side walls include two vertical front edges which are bent out of the flange of the remainder of the side walls. A front unit is provided which comprises a frame and a door swingably mounted to the frame. The frame includes a pair of vertical ledges formed as rearwardly open vertical channels in which the bent forward edges of the side walls are frictionally received.

In still another aspect of the invention, a cover is provided which is disposed atop the housing and includes a front edge in the form of a rearwardly open channel. The upper edge of the frame of the front unit includes an upper edge which extends horizontally forwardly and into the rearwardly open channel of the cover.

Preferably, the cover includes downwardly depending flanges which fit along and to the outside of, upper edges of the side and rear walls. The upper edges of the side and rear walls are bent inwardly to facilitate placement of the depending flanges thereover. The flanges are disposed in tight frictional engagement with the side and rear walls.

The side and rear walls include horizontal flanges along their lower edges, the flanges being bent inwardly and resting upon ground support legs, there being no upwardly open channels exhibiting a tendency to collect moisture.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 5 is a horizontal sectional view taken along the line 5—5 in FIG. 4;

FIG. 6 is a horizontal sectional view taken through a front edge of one of the side walls of the housing, and a rearwardly open channel defined by a front unit, as the front edge of the housing is being inserted into the channels;

FIG. 7 is a view similar to FIG. 6 showing the front edge frictionally locked within the rearwardly open channel.

DETAILED DESCRIPTION OF PREFERRED EMBODIMENTS OF THE INVENTION

Figure 3:
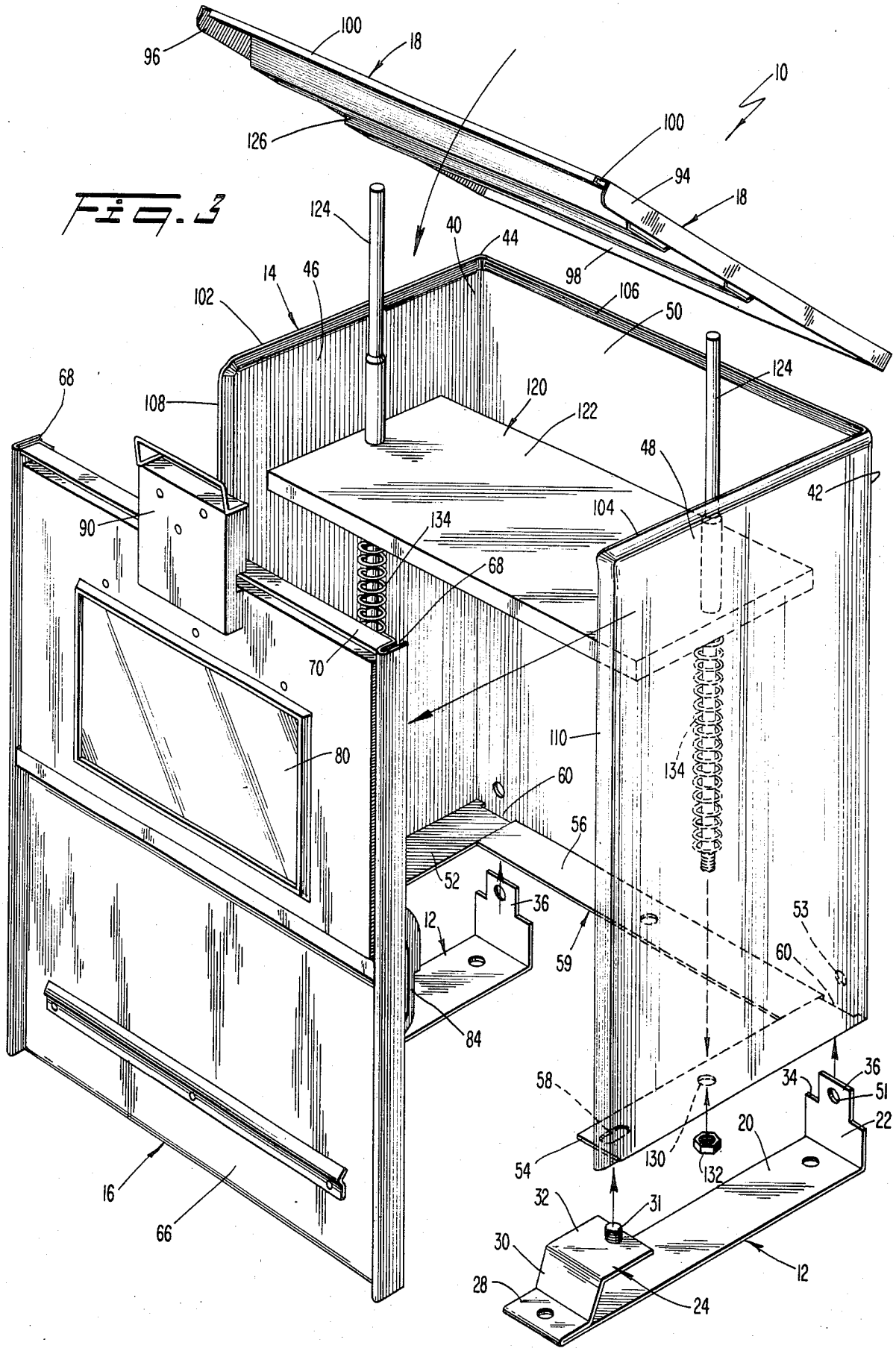
FIG. 3 is an exploded perspective view of the display rack depicted in FIG. 1, with a coin-receiving mechanism being omitted therefrom.

A knock-down display rack 10 according to the present invention comprises a pair of base legs 12, a housing 14, a front panel 16, and a cover 18. The base legs 12 each comprise a horizontal ground supportion portion 20 (FIG. 3), a rear flange 22 projecting upwardly from a rear end of the ground support portion 20, and a front arm 24. The front arm 24 includes (i) a first section 28 which is folded over upon the ground support portion to define a foot 25, (ii) a rearwardly and upwardly inclined portion 30, and (iii) a ledge 32 projecting horizontally rearwardly from the upper end of the inclined portion 30. Projecting upwardly from each of the ledges 32 is a threaded pin 31. The flange 22 includes a pair of horizontal shoulders 34 located at the same elevation as the ledge 32, and a tab 36 which projects upwardly beyond the shoulders 34.

The housing 14 comprises a wall member 40 constituted by a piece of sheet metal bent into a U-shape along two vertical fold lines 42, 44 to define two side walls 46, 48 and a rear wall 50. Lower edges of each of the walls 46, 48 and 50 are bent inwardly at 90° to form two horizontal side flanges 52, 54 and a rear flange 56. Those flanges together define a ledge 59. Formed in the side flanges 52, 54 at front ends thereof are slots 58. At the juncture between the rear wall 50 and the side flanges 52, 54, the side flanges are formed with narrow slits 60.

The housing member 14 is mountable upon the base legs 12 by laying the side flanges 52, 54 upon the ledges 32 so that the threaded pins 31 enter the slots 58, and the upstanding tabs 36 enter the slits 60. The length and width dimensions of the slits 60 are commensurate with the corresponding length and width dimensions of each of the tabs 36 so that the ledge 59 comes to rest upon the shoulder 34 and the tab 36 bears against the rear wall 50. Hence, essentially no "play" is permitted between the tab 36 and the housing 14. A bolt and nut fastener 61 (FIG. 4) extends through a hole 51 in each tab 36 and a hole 53 in the rear wall 50.

Figures 4, 8:
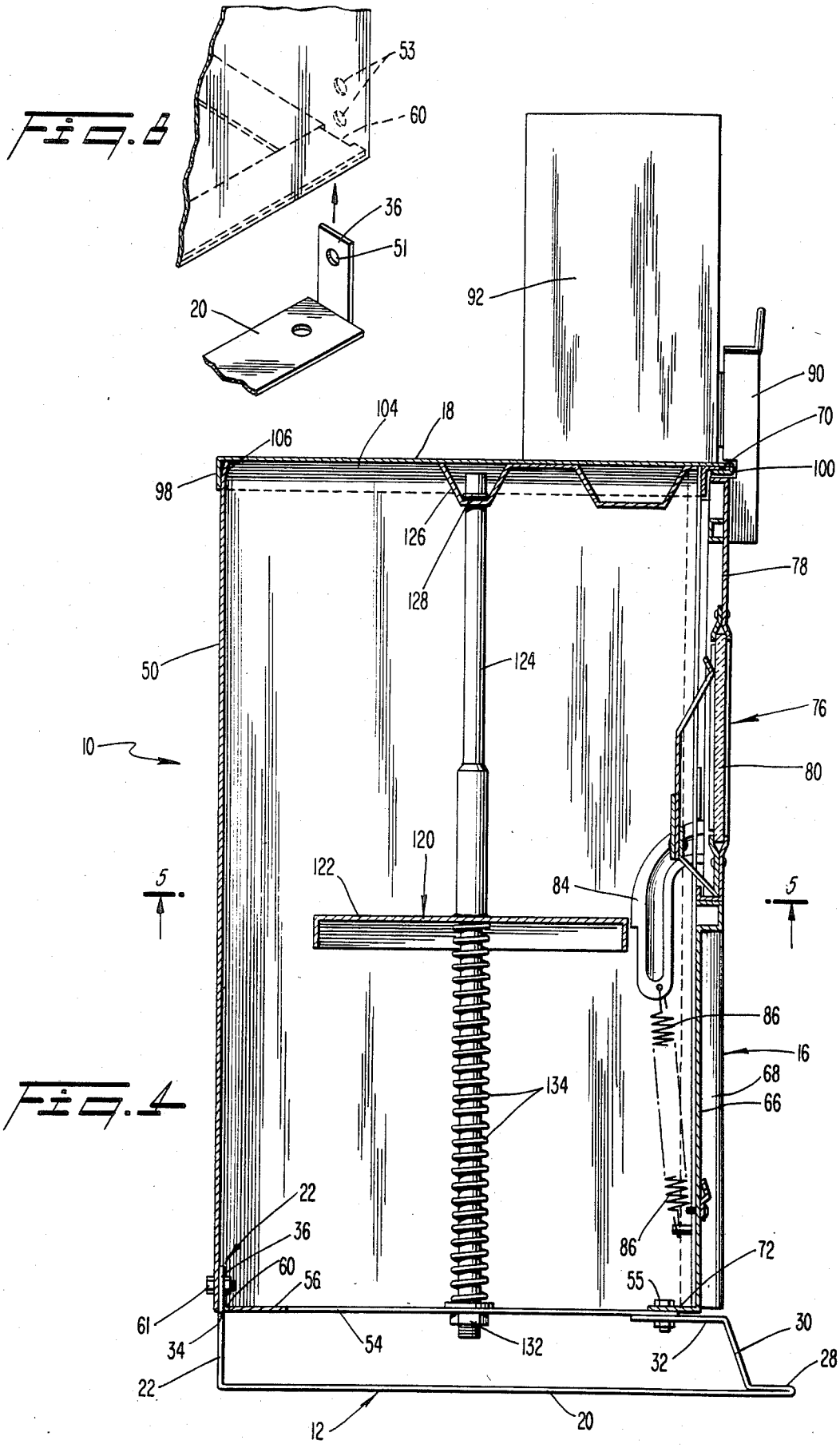
FIG. 4 is a vertical sectional view taken along the display rack, with the front door in a closed condition.
FIG. 8 is a fragmentary perspective view of a further embodiment of the present invention.

Alternatively, the shoulders 34 could be eliminated, and the tab or rear wall could be provided with a plurality of vertically spaced holes to provide for selected adjustment of the position of the tab relative to the rear wall, as depicted in FIG. 8.

Threaded nuts 55 (FIG. 4) can be screwed onto the pins 31 to secure the front ends of the side flanges 52, 54 to the base legs 12.

Figure 2:
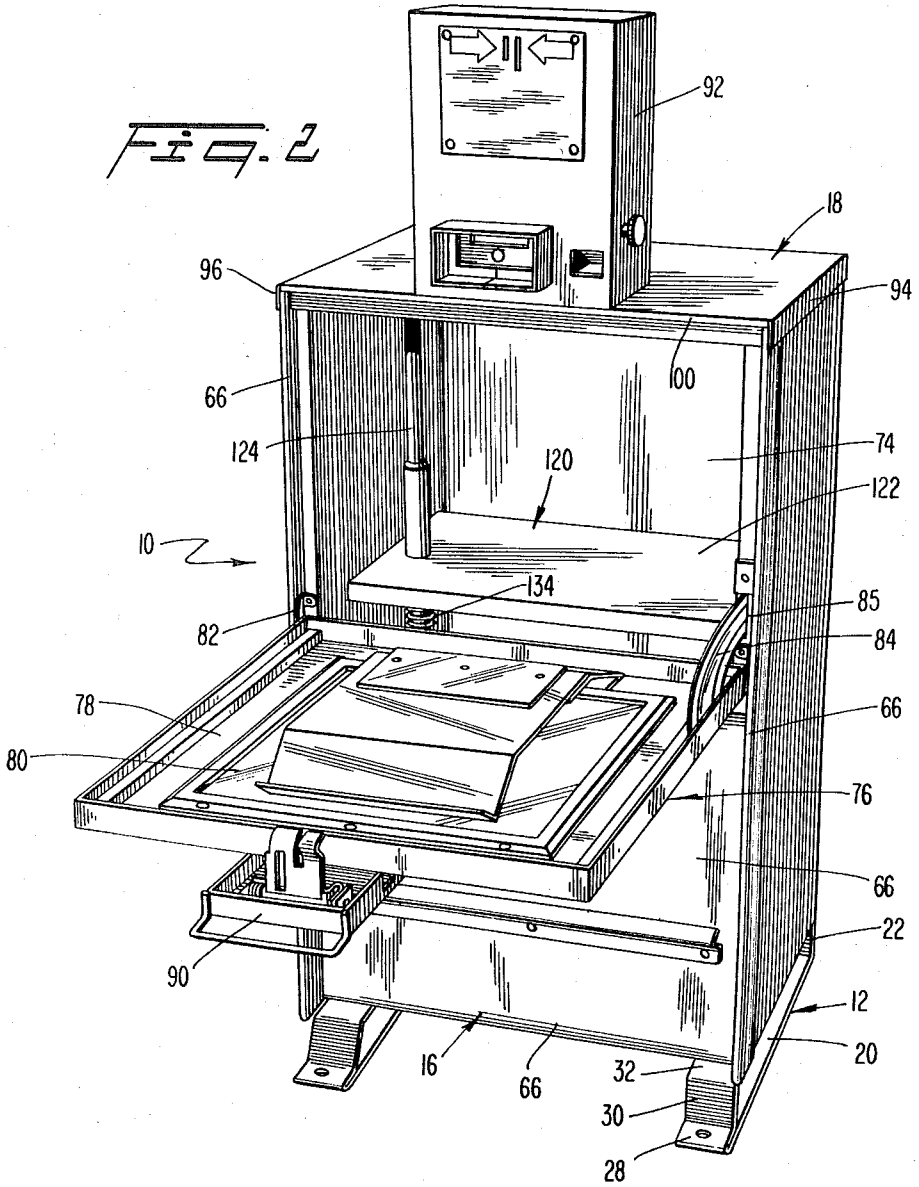
FIG. 2 is a view similar to FIG. 1 with the front door in an opened condition.
Figure 1:
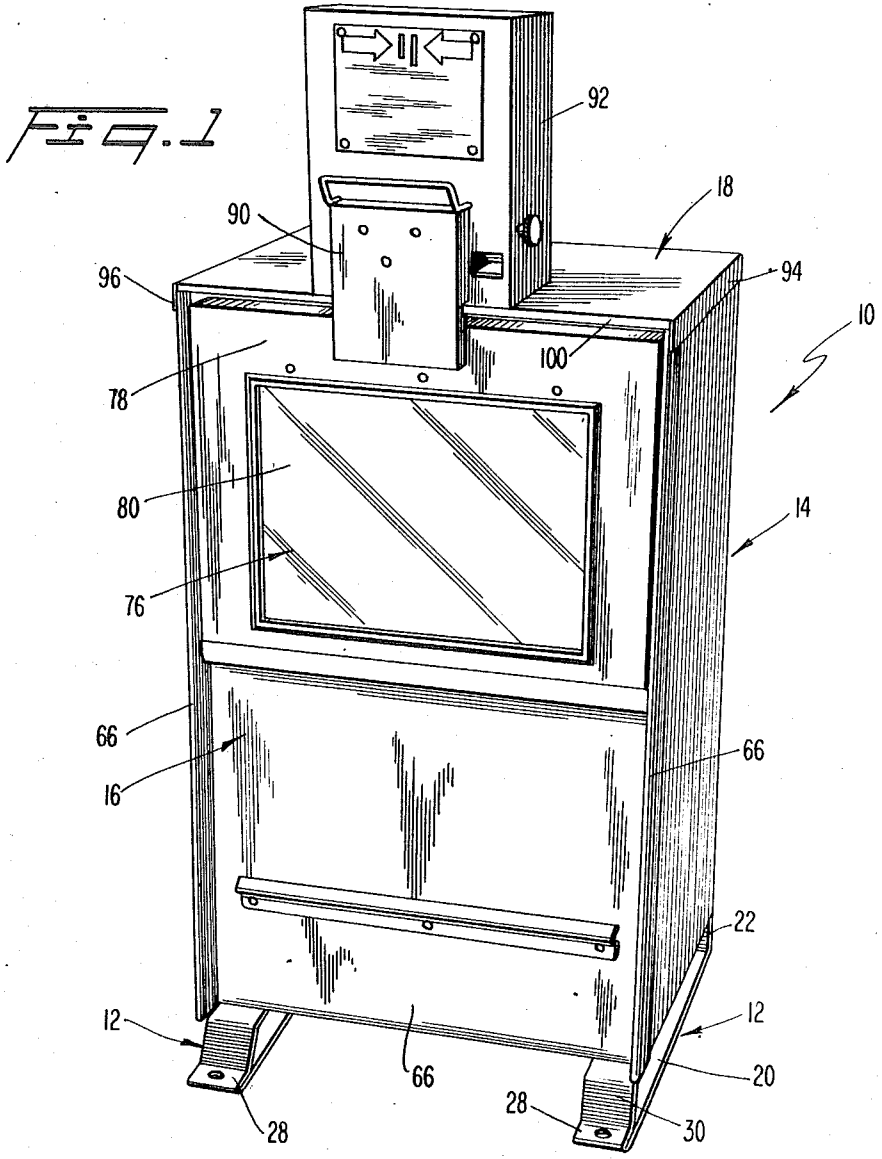
FIG. 1 is a front perspective view of a knock-down display rack according to the present invention, with the front door in a closed condition.

The front panel 16 comprises a frame preferably in the form of a plate 66 which is bent along two vertical sides to form rearwardly facing vertical channels 68. The plate 66 is also bent outwardly along its upper edge to form a forwardly projecting horizontal lip 70. Along its lower edge the plate 66 is bent rearwardly to form a horizontal flange 72 (FIG. 4). A lower half of the plate 66 is solid, whereas the upper half thereof contains an aperture 74 (FIG. 2) which is closed by a door 76 pivotable mounted on the plate 66.

The door 76 includes a plate 78 in which is formed an opening covered by a window 80 of transparent material such as plastic. Suitable hinges 82 (FIG. 2) rotatably support a lower edge of the door so that the door can be swung open and closed about a horizontal axis. A guide 84 affixed to the plate 78 slides within a slot 85 in the plate 66 to guide the rotary movement of the door. A coil tension spring 86 (FIG. 4) has its ends connected to the guide 84 and the plate 66, respectively, in order to bias the door to a closed condition.

A standard latching device 90 is affixed to the plate 78 and projects above the plate 66. This latching device cooperates with a standard coin-operated unlocking mechanism 92 which is mounted upon the cover 18 and need not be described in greater detail since it is conventional and does not constitute a novel aspect of the present invention. Attention is directed to U.S. Pat. Nos. 3,760,923; 3,945,228; and 4,135,375 for disclosures of a suitable latch device and coin-operated unlocking-/locking mechanism. The disclosures of those patents are incorporated herein by reference.

The top cover 18 comprises a sheet metal plate having its side and rear edges bent downwardly to form downwardly depending side flanges 94, 96 and a rear flange 98. A front edge of the cover 18 is bent downwardly and rearwardly to form a rearwardly opening horizontal channel 100 (FIG. 4) to lock the door plate and top cover together. Also during assembly, the upper edges 102, 104, 106 of the side and rear walls 46, 48, 50 make sliding contact with the insides of the flanges 94, 96, 98. Those upper edges 102, 104, 106 are each bent slightly inwardly (e.g., see the bent edge 106 in FIG. 4), to facilitate insertion of the flanges 94, 96, 98 thereover. Furthermore, the spacing between the flanges 94, 96, 98 is such as to assure that a tight frictional fit occurs with the walls 46, 48, 50. For example, the flanges 94, 96, 98 could be slightly cammed outwardly as they progress downwardly along the bent edges 102, 104, 106. Thus, the flanges 94, 96, 98 are able to fit over the upper edges 102, 104, 106 of the walls 46, 48, 50 while still firmly engaging non-bent portions of the walls to assure a rattle-free mounting of the cover on the housing.

The vertical front edges 108, 110 of the side walls 46, 48 are bent slightly inwardly as can be viewed in FIGS. 6 and 7. The width of the vertical channels 68 in the plate 66 is such as to assure that when the edges 108, 110 enter the channels, the edges are flexed slightly outwardly (compare FIGS. 6 and 7). Thus, a rattle-free fit of the side walls within the channels is affected.

Disposed within the machine is an elevator 120 for carrying publications. The elevator comprises a shelf 122 guided for vertical sliding movement upon a pair of upright rods 124. Upper ends of the rods are received in holes formed in a bracket 126 (FIG. 4) attached to the underside of the cover 18. A pin 128 is attachable to the upper end of each rod to prevent removal of the rod from the bracket. Such a pin is disclosed for example in U.S. Pat. No. 4,449,643.

Threaded lower ends of the rods 124 extend through holes 130 in the flanges 52, 54 in the side walls 46, 48, and nuts 132 are secured to those lower ends to secure the rods to the flanges while drawing the cover 18 and the legs 12 toward one another.

A coil compression spring 134 is mounted on each rod 124 and acts between the shelf 122 and the side flanges 52, 54 to bias the shelf 122 upwardly. The springs 134 are compressed under the load of the stack of publications seated on the shelf and gradually push the shelf upwardly as the stack of publications becomes diminished.

It will be appreciated that a rack according to the present invention involves no upwardly open channels which are susceptible to accelerated rusting. Furthermore, the rack can be easily knocked down upon removal of a few bolts. Despite the fact that the rack can be knocked down, the parts are firmly secured in an essentially rattle-free manner due to the provision of bent or crimped edges which provide for a firm frictional engagement of the cover and the front panel with the side walls. The insertion of the forwardly projecting lip 70 of the front panel into the rearwardly opening channel 100 of the cover serves to secure the front panel and cover together without separate fasteners. The projection of the tab 36 into the slit 60 produces resistance against twisting movement of the side and rear walls.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A knock-down display rack for publications such as newspapers comprising:

a pair of base legs supportable on the ground and each including a horizontal ledge spaced above the ground at a front end of said base leg, and an upstanding flange at a rear end of said base leg, said flange defining an upstanding tongue, a housing comprising a sheet of material bent along two vertical corners to define a U-shaped wall member comprised of a pair of parallel upright side walls and a rear wall therebetween, front vertical edges of said side walls being bent out of the plane of the remainder of said side walls, lower horizontal edges of said side and rear walls being bent inwardly to form horizontal side and rear flanges, with front ends of said side flanges resting on said ledges, and rear ends of said side flanges having slots sized to receive said upstanding tabs, fastener means for securing said ledges to said side flanges and for securing said tabs to said rear wall, a front unit comprising a frame and a door swingably mounted thereto, said frame including a lower edge bent inwardly to form a horizontal flange resting on said ledges, a pair of upright edges bent to form rearwardly open channels which receive said bent front edges of said side edges in a manner causing a deformation of said bent edges to effect a friction-fit, and an upper edge bent hoirzontally forwardly, a cover mounted atop said housing and frame, said cover including a plurality of donwardly bent peripheral edges forming two side flanges and a rear flange, which flanges bear against outside faces of said side and rear walls, respectively, and a front edge bent rearwardly to form a rearwardly open hoirzontal channel which receives said upper edge of said frame, a plurality of rods extending between, and coupled to, said base legs and said cover to draw said cover and base legs toward one another, and a shelf slidably mounted on for up-and-down movement, said rods and spring biased upwardly.

* * * * *